US008435140B1

(12) United States Patent
Seluga et al.

(10) Patent No.: US 8,435,140 B1
(45) **Date of Patent: *May 7, 2013**

(54) METHOD OF FITTING A GOLF CLUB TO A GOLFER

(75) Inventors: James A. Seluga, San Diego, CA (US); Matthew T. Cackett, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/372,237

(22) Filed: Feb. 13, 2012

Related U.S. Application Data

(63) Continuation of application No. 13/091,724, filed on Apr. 21, 2011, now Pat. No. 8,113,967.

(60) Provisional application No. 61/326,548, filed on Apr. 21, 2010.

(51) Int. Cl.
*A63B 53/00* (2006.01)

(52) U.S. Cl.
USPC ..... 473/409; 473/131

(58) Field of Classification Search ..... 473/131, 473/223, 289, 407, 409
See application file for complete search history.

(56) References Cited

U.S. PATENT DOCUMENTS

| | | | | |
|---|---|---|---|---|
| 6,041,651 | A * | 3/2000 | Naruo et al. | 73/491 |
| 6,083,123 | A * | 7/2000 | Wood | 473/409 |
| 6,192,323 | B1 * | 2/2001 | Boehm | 702/182 |
| 6,702,692 | B1 * | 3/2004 | Smith | 473/289 |
| 6,719,648 | B1 * | 4/2004 | Smith | 473/409 |
| 7,887,440 | B2 * | 2/2011 | Wright et al. | 473/409 |
| 8,113,967 | B1 * | 2/2012 | Seluga et al. | 473/409 |
| 2003/0008731 | A1 * | 1/2003 | Anderson et al. | 473/407 |
| 2004/0204257 | A1 * | 10/2004 | Boscha et al. | 473/131 |

* cited by examiner

*Primary Examiner* — Nini Legesse
(74) *Attorney, Agent, or Firm* — Rebecca Hanovice; Michael A. Catania; Sonia Lari

(57) ABSTRACT

The method generally involves obtaining data for the golfer's typical playing characteristics using a plurality of golf clubs, determining an average end location for each of a plurality of shots taken with each of a plurality of golf clubs, and calculating the distance from the end location of each of the plurality of shots taken with each of the plurality of clubs to a target location, each distance being a putt distance.

12 Claims, 1 Drawing Sheet

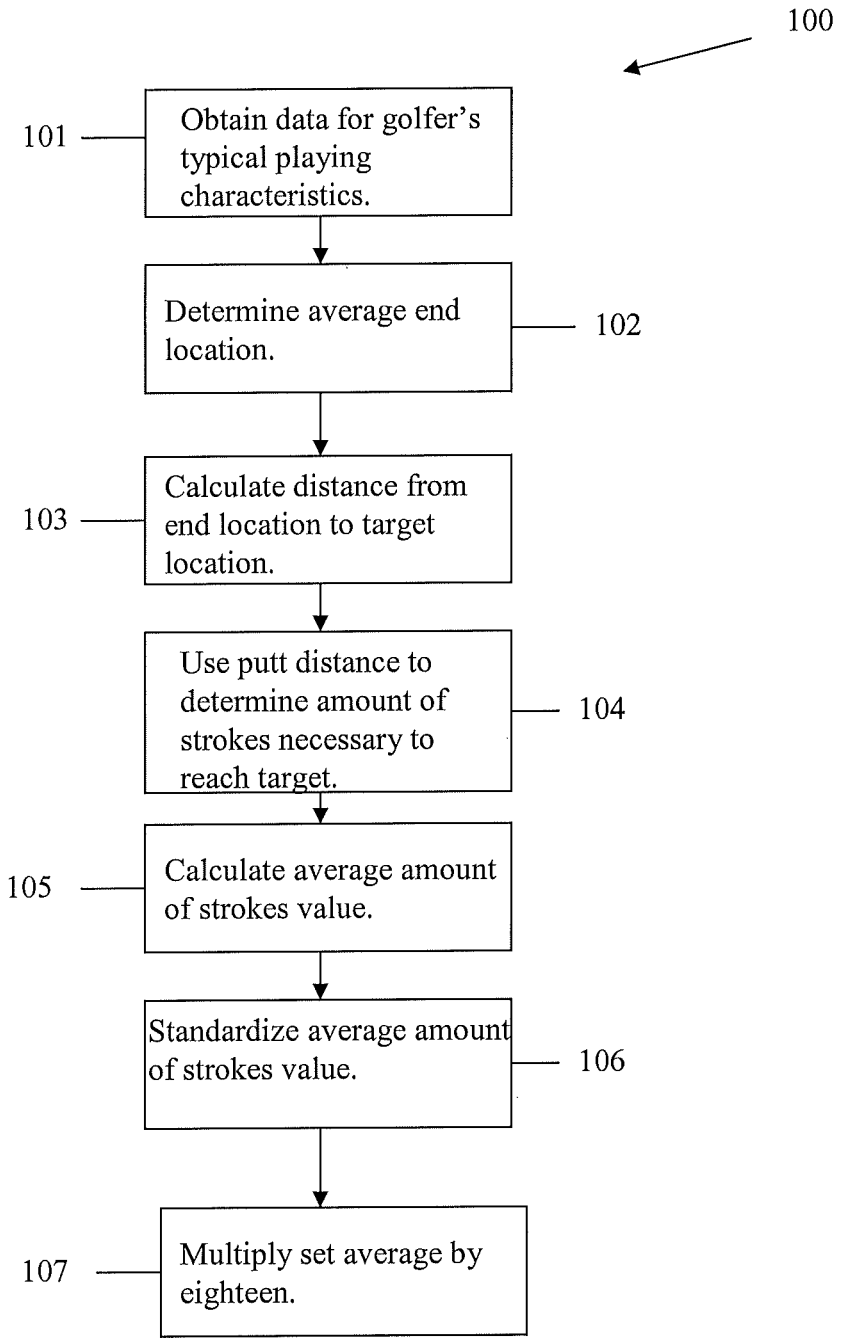
100
101
Obtain data for golfer's typical playing characteristics.
Determine average end location.
102
103
Calculate distance from end location to target location.
Use putt distance to determine amount of strokes necessary to reach target.
104
105
Calculate average amount of strokes value.
Standardize average amount of strokes value.
106
107
Multiply set average by eighteen.

METHOD OF FITTING A GOLF CLUB TO A GOLFER

CROSS REFERENCES TO RELATED APPLICATIONS

The present application is a continuation of U.S. patent application Ser. No. 13/091,724, filed on Apr. 21, 2011, which issued on Feb. 14, 2012, as U.S. Pat. No. 8,113,967, and which claims priority to U.S. Provisional Patent Application No. 61/326,548 filed on Apr. 21, 2010.

STATEMENT REGARDING FEDERALLY SPONSORED RESEARCH OR DEVELOPMENT

Not Applicable

BACKGROUND OF THE INVENTION

1. Field of the Invention

The present invention relates a method for fitting a golf club to a golfer.

2. Description of the Related Art

U.S. Pat. No. 6,702,692 for a Precise Fit Golf Club Fitting System And Golf Shaft Selection Method And Apparatus.

U.S. patent application Ser. No. 10/188,669 for an Automated Method And System For Golf Club Selection Based On Swing Type.

U.S. Pat. No. 6,719,648 for a Precise Fit Golf Club Fitting System And Golf Shaft Selection Method And Apparatus.

U.S. Pat. No. 6,083,123 for Method For Fitting Golf Clubs For Golfers.

U.S. patent application Ser. No. 10/602,075 for a Method For Matching Golfers With A Driver And Ball.

BRIEF SUMMARY OF THE INVENTION

The present invention is a method for fitting a golf club for a golfer based on the golfer's ball striking characteristics. The method generally involves obtaining data for the golfer's typical playing characteristics using a plurality of golf clubs, determining an average end location for each of a plurality of shots taken with each of a plurality of golf clubs, and calculating the distance from the end location of each of the plurality of shots taken with each of the plurality of clubs to a target location, each distance being a putt distance. The method further comprises using the putt distance to determine an amount of stokes necessary to reach the target location from the end location for each of the plurality of shots taken with each of the plurality of golf clubs. An average amount of strokes value is calculated for each of the plurality of golf clubs. The average amount of strokes value is standardized to determine a set average. The set average is then multiplied by eighteen which gives an average strokes per round saved value.

This method can be used to automate a player's selection of golf clubs for the set they build and can also be used to develop devices to suggest potential golf clubs for player's based on historical distributions stored on that device.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 1 is a flow chart of a preferred method of the present invention.

DETAILED DESCRIPTION OF THE INVENTION

As shown in FIG. 1, a method for fitting a golf club to a golfer based on the golfer's ball striking characteristics is provided 100. The method comprises obtaining data for a golfer's typical playing characteristics using a plurality of golf clubs 101. An average end location for each of a plurality of shots taken with each of the plurality of golf clubs is determined 102. The distance from the end location of each of the plurality of shots taken with each of the plurality of golf clubs is calculated, and termed the putt distance 103. The putt distance is used to determine the amount of strokes necessary to reach the target location from the end location for each of the plurality of shots taken with each of the plurality of golf clubs 104. An average amount of strokes value for each of the plurality of golf clubs is calculated 105. The average amount of strokes value is standardized to determine a set average 106. The set average is then multiplied by eighteen to obtain an average stroke per round saved value 107. Preferably, the target location is the location of the hole. The strokes per round saved value can be compared from one set to another set to determine the potential benefit of strokes saved. The set average can be multiplied by eighteen because one of the clubs within the defined set will be used as an approach to the target location. Additionally, the method may further comprise using the average amount of strokes value for each of the plurality of golf clubs to provide the golfer with a plurality of suggested clubs based on a club selection that would give a lowest average score for the hole.

In one embodiment, the method further comprises wherein the plurality of suggested clubs comprises three options that would give the three lowest average scores for the hole at each location. In another embodiment, the method comprises wherein the golfer can compare the lowest average score for a particular course with another golfer's lowest average score for the same course. In yet another embodiment, the method comprises wherein the golfer can compare the lowest average score for a particular hole with another golfer's lowest average score for the same hole. Further, the method may comprise wherein the golfer is given a predictive score based on use each option of the plurality of suggested clubs. Also, the method preferably comprises wherein the golfer is given an assigned risk associated with each option of the plurality of suggested clubs.

The method comprises taking a downrange dataset from a test of a given golf club as the input dataset. A target is developed for that particular set of data. The target is calculated using the average end location of all shots. The target is preferably the holes location. The distance of every shot is calculated within the downrange data set to the target and recorded as a putt distance. With each putt distance, the method predicts an average amount of strokes from each shot to the target. The average amount of strokes for all shots is averaged to determine the average strokes for each club. The average strokes for each club is averaged across a set of clubs with either a weighted or standard average to determine the set average. The set average is multiplied by 18 to determine an average strokes per round. The strokes per round can be compared from one set to another set to determine the potential benefit of the strokes saved.

The method of determining club selection based upon lowering the golfer's score is used as a course assistant to determine the lowest possible score for the golfer. The method putt distance at the end of each shot and the average for each club stored is sued to determine the golfer's club selection at each location on the golf course that reduces the risk on each shot. The information is used to simulate a round using player data and for each combination of predicted clubs, a score for each hole can be determined. The club selection with the lowest average score for the hole can be given to the player. The lowest average score at each location can be recalculated at each hole. A choice of three club combination selections can be given at the start of the hole with a predictive score and the assigned risk of each choice at the start of the hole, which allows the golfer to select the risk and reward of each club combination. The risk is calculated using the standard deviation of the predicted scores from the combination of clubs within the prediction. Further, a collective group of golfers can use the strokes saves in the rating of golf courses using a representative golfer population to calculate the average scores and rate course against course or hole against hole.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A method comprising:

obtaining a downrange dataset comprising a series of shots from a test of a golf club in a golf club set;

developing a target for the downrange dataset;

calculating a distance of every shot within the downrange dataset to the target;

recording the distance as a putt distance;

predicting an average number of strokes from each shot to the target;

averaging the average number of strokes to determine the average strokes for each club in the golf club set;

averaging the average strokes for each club across the set of clubs to determine a set average;

multiplying the set average by eighteen to determine an average strokes per round.

2. The method according to claim 1, wherein the target is calculated using an average end location of all shots in the dataset.

3. The method according to claim 1, wherein the target is a hole location.

4. The method according to claim 1, wherein the step of averaging the average strokes for each club across a set of clubs to determine a set average is performed using a weighted average.

5. The method according to claim 1, wherein the step of averaging the average strokes for each club across a set of clubs to determine a set average is performed using a standard average.

6. The method according to claim 1, further comprising comparing the average strokes per round from the golf club set with an average strokes per round from another golf club set to determine a potential benefit of strokes saved.

7. A method of selecting a golf club to lower a golfer's score, the method comprising:

having the golfer take a plurality of putting shots towards at least one golf course hole using a plurality of combinations of golf clubs;

calculating a putt distance at the end of each shot;

averaging the putt distance from the shots for each golf club;

simulating a round using the averaged putt distance for each combination of golf clubs;

calculating a score based upon the averaged putt distance for each of the combination of golf clubs; and providing the golfer with the combination of golf clubs having the lowest score.

8. The method according to claim 7, further comprising identifying a golf club combination having a lowest risk of missing a shot.

9. The method according to claim 7, wherein the step of having the golfer take a plurality of putting shots using a plurality of combinations of golf clubs further includes having the golfer take said plurality of shots at a plurality of locations on a golf course.

10. The method according to claim 9, wherein the step of calculating a score for each combination of golf clubs further comprises calculating a lowest average score at each of the plurality of locations on the golf course.

11. The method according to claim 7, wherein the plurality of golf club combinations is composed of three club combinations.

12. The method of claim 11, wherein each of the three club combinations has a predictive score and an assigned risk, and wherein the assigned risk is calculated using the standard deviation of predicted scores from the combination of clubs.

* * * * *